US007415834B2

(12) United States Patent
Marret et al.

(10) Patent No.: US 7,415,834 B2
(45) Date of Patent: Aug. 26, 2008

(54) IN-DOOR WATER DISPENSER WITH DOOR REVERSIBILITY

(75) Inventors: Diane E. Marret, Newburgh, IN (US); Guy E. Garrison, Evansville, IN (US); Jill C. Moeller, Evansville, IN (US); Johnny R. Revlett, Robards, KY (US); Mark G. Steffenhagen, Evansville, IN (US); Daryl L. Reuter, Evansville, IN (US); Jeff J. Smale, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/782,683

(22) Filed: Jul. 25, 2007

(65) Prior Publication Data

US 2008/0011012 A1 Jan. 17, 2008

Related U.S. Application Data

(62) Division of application No. 10/977,997, filed on Oct. 29, 2004, now Pat. No. 7,281,391.

(51) Int. Cl.
*B67D 5/62* (2006.01)

(52) U.S. Cl. ..... 62/177; 62/389; 222/146.6

(58) Field of Classification Search ..... 62/177, 62/389–391; 222/146.6
See application file for complete search history.

(56) References Cited

U.S. PATENT DOCUMENTS 3,429,140 A * 2/1969 White ..... 62/339
4,543,800 A * 10/1985 Mawby et al. ..... 62/339
5,359,795 A * 11/1994 Mawby et al. ..... 40/405
5,787,724 A * 8/1998 Pohl et al. ..... 62/389
5,941,619 A * 8/1999 Stieben et al. ..... 312/223.6

* cited by examiner

*Primary Examiner*—William E Tapolcai
(74) *Attorney, Agent, or Firm*—Kirk Goodwin; Michael D. LaFrenz

(57) ABSTRACT

A refrigerator with at least one openable door has a hinge at a pivoting edge of the door allowing the door to open about the pivoting edge. A water dispenser, positioned on the door, has a paddle which is moved horizontally by a user to cause water to be dispensed. The paddle engages a toggle that is attached to the dispenser housing, causing the toggle to rotate into engagement with a microswitch. The microswitch is mounted on a user interface control board which communicates with a power supply electronic control board. The power supply control board operates a water dispenser solenoid valve to cause water to flow to the dispenser when the toggle engages the microswitch. An endcap is secured to an edge of the door adjacent to the pivoting edge. A first conduit extends from the water dispenser to an end within the endcap. A second conduit extends from within the cabinet to an end exterior of the cabinet and within the endcap. An end connector is provided to receive the ends of the first and second conduits. The hinge is movable from the pivoting edge of the door to an opposite edge of the door. The second conduit is arranged to exit from either adjacent one corner or adjacent an opposite corner of the cabinet to be adjacent to the pivoting edge. The two conduits are joinable within the endcap at the end connector to form a continuous conduit.

17 Claims, 4 Drawing Sheets

IN-DOOR WATER DISPENSER WITH DOOR REVERSIBILITY

CROSS-REFERENCE TO RELATED APPLICATIONS

The present application constitutes a divisional application of U.S. patent application Ser. No. 10/977,997, allowed, entitled "IN-DOOR WATER DISPENSER WITH DOOR REVERSIBILITY" filed Oct. 29, 2004.

BACKGROUND OF THE INVENTION

Refrigerators with in-door water dispensers are known in which the dispenser is accessible from an exterior of the refrigerator, and is able to selectively dispense chilled liquid water or ice. In order to permit the dispenser to work, a water conduit must extend from the refrigerator cabinet to the door. Typically this is done with a conduit that is routed along an area close to a hinged side of the pivotally openable door so that the conduit will not be readily visible or exposed to a great degree when the door is opened.

Refrigerator doors may be attached to the cabinet in either a right-hand opening position, with the hinge arranged along the right edge of the door, or a left-hand opening position, with the hinge arranged along the left edge of the door. In order to switch a refrigerator door from a right-hand opening position to a left-hand opening position, when an in-door water dispenser is present, the routing of the water supply conduit, and usually control or power wires, must be changed. This usually requires that the door interior be opened up so that the in-door dispenser may be accessed to allow disconnection of the conduit and wiring at the dispenser. This may involve a substantial effort on the part of an appliance owner, and could result in the improper reassembly of the door.

It would be an improvement in the art if there were an arrangement provided which would permit changing the swing of a door without requiring that the interior of the door be opened, and which would permit all changes to be performed from the front of the appliance.

SUMMARY OF THE INVENTION

The present invention provides an arrangement which permits changing the swing of an appliance door without requiring that the interior of the door be opened to access an in-door apparatus, and which would permit all changes to be performed from the front of the appliance.

In an embodiment of the invention, an appliance cabinet is provided with at least one openable door having a hinge at a pivoting edge of the door to allow the door to open about the pivoting edge. An endcap is secured to an edge of the door adjacent to the pivoting edge. A first conduit extends from an in-door apparatus to an end within the endcap. A second conduit extends from within the cabinet to an end exterior of the cabinet and within the endcap. An end connector is provided to receive the ends of the first and second conduits. The hinge is movable from the pivoting edge of the door to an opposite edge of the door. The second conduit is arranged to exit from either adjacent one corner or adjacent an opposite corner of the cabinet to be adjacent to the pivoting edge. In this arrangement, the two conduits are joinable within the endcap at the end connector to form a continuous conduit.

DETAILED DESCRIPTION OF THE PREFERRED EMBODIMENT

The present invention provides an arrangement which permits changing the swing of an appliance door without requiring that the interior of the door be opened to access an in-door apparatus, and which would permit all changes to be performed from the front of the appliance. The invention may be used on a wide variety of appliances, where "appliance" is understood in its broadest sense to include not only powered appliances such as refrigerators, freezers, ovens, dishwashers, etc., but also unpowered appliances including cabinets and other objects having pivotally openable doors. In order to discuss the present invention in terms of a particular appliance, the invention is shown as being embodied in a refrigeration appliance with an in-door water dispenser, however, it should be understood that the invention is not limited to use in refrigerators or only with water dispensers.

Figure 1:
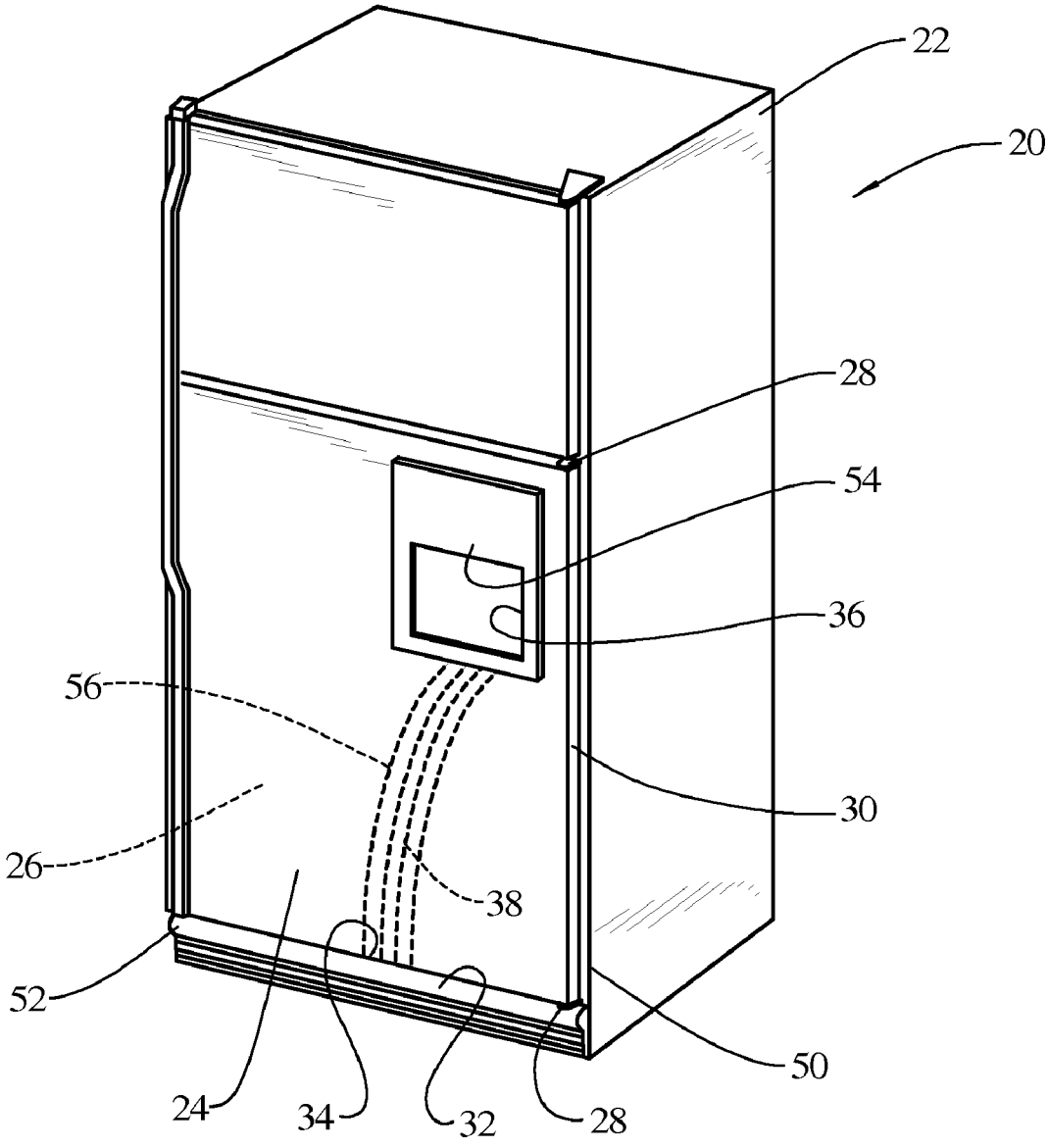
FIG. 1 is a perspective view of a refrigeration appliance embodying the present invention.

In FIG. 1 an appliance in the form of a refrigerator 20 is illustrated which has a cabinet 22, here being the external cabinet, having at least one pivotally openable door 24 to provide access to an interior compartment 26. Appliances with two or more doors could also embody the present invention. The interior compartments of such appliances may or may not be refrigerated, and might also be heated, water filled at times, or may merely be at ambient condition.

A hinge connection 28 is provided at a pivoting edge 30 of the door 24 to allow the door to pivotally open about the pivoting edge of the door. As will be discussed below, this hinge connection 28 may be provided along any edge of the door 24, and may be movable to an opposite edge of the door. Although the drawings show only an arrangement where the hinge connection 28 is located along the vertical right and left edges, they may also be provided along the top or bottom edges in some appliances.

An endcap 32 is secured to an edge 34 of the door 24 adjacent to the pivoting edge 30 of the door 24. In the embodiment illustrated, the endcap 32 is removably secured to the bottom edge 34 of the door 24, however, it could also be positioned at the top edge in some appliances. Also, when the hinge connection 28 is located along the top or bottom edge, the endcap 32 would be located along either the right or left edge of the door 24.

An in-door apparatus 36, shown here as a water dispenser, is positioned in the door 24 and may be accessible from an exterior of the cabinet 22. Other apparatus may be used with the present invention including other types of dispensers and other apparatus that are not dispensers. Generally the types of apparatus which would utilize the present invention are those that require some type of communication with the cabinet 22, such as for transmission of fluids, electrical power, signals utilizing the electromagnetic spectrum, including sound waves, or similar types of communication needs.

In the embodiment illustrated, a first water conduit 38 extends from the in-door water dispenser 36 to an end connector 44 (FIGS. 4 and 5) located within the endcap 32 adjacent to the pivoting edge 30 of the door 24. Of course in some embodiments, the conduit 38 will not be used for transporting water, but may be used for transporting any number of different things, as described above. The end connector 44 may be a threaded type end connector, or may have other types of connection features, including friction fits, snap connections, bayonet connections, etc., as required or functional with the particular items being transported in the conduit. The end connector 44 may be located at a wide range of positions within the endcap 32, not necessarily limited to a position adjacent to the pivoting edge 30 of the door 24.

Again, in the embodiment illustrated, a second water conduit 42 extends from within the cabinet 22 to the end connector 44 exterior of the cabinet adjacent to the pivoting edge 30 of the door 24 and within the endcap 32. As with the first conduit 38, the second conduit 42, in some embodiments may not be used for transporting water, but may be used for transporting any number of different things, as described above. The end connector 44 may be a single piece that each conduit 38, 42 is attached to, or may be formed in two pieces that have a compatible connection arrangement to each other. The end connector 44 may be located at a wide range of positions within the endcap 32, not necessarily limited to a position adjacent to the pivoting edge 30 of the door 24.

The hinge connection 28 is selectively movable from the pivoting edge 30 of the door 24 to an opposite edge 46 of the door to permit the door to be alternatively opened from one edge or an opposite edge. As mentioned above, the illustrated embodiment shows the hinge connection 28 originally being positioned along the right vertical edge, so it could be moved to the left vertical edge. In some appliances, the door 24 may be hinged along the top or bottom edge, and would be movable to the opposite, or bottom or top edge, respectively.

The second water conduit 42 is selectively arranged to exit from either adjacent one corner 50 or adjacent an opposite corner 52 of the cabinet 22 to be adjacent to the pivoting edge of said door, regardless of where it is moved to.

The first water conduit 38 and the second water conduit 42 are joinable by means of the end connector 44 within the endcap 32 to form a continuous leak-tight water conduit from within the cabinet 22 to the in-door water dispenser 36.

In the particular embodiment illustrated, the in-door water dispenser 36 includes a dispenser housing 54 mounted in the door 24. In this embodiment, the dispenser housing 54 is foamed-in-place within the door 24 to provide enhanced insulation and simplified construction of the door. In other embodiments, a separate housing may not be present with the in-door apparatus 36, and insulation, foamed-in-place or not, may not be used or required.

In the illustrated embodiment, a hollow conduit 56 extends from the dispenser housing 54 to the bottom edge 34 of the door 24, where the endcap 32 is located. Such a conduit 56 permits the foamed-in-place operation to occur before the remainder of the assembly process occurs. The hollow conduit 56 is sized to receive the first water conduit 38 therethrough. The hollow conduit 56 may also be sized to receive electrical wires therethrough. In other embodiments, the hollow conduit 56, if used, should be sized to receive whatever conduits, including wires, are extending between the cabinet 22 and the in-door apparatus 36.

Figure 2:
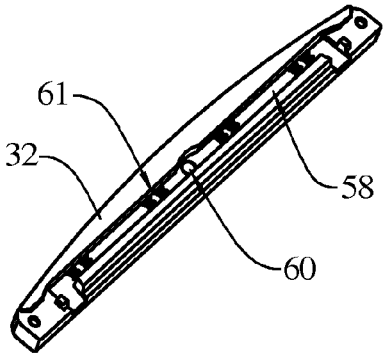
FIG. 2 is a bottom elevational view of an endcap used with the present invention.
Figure 3:
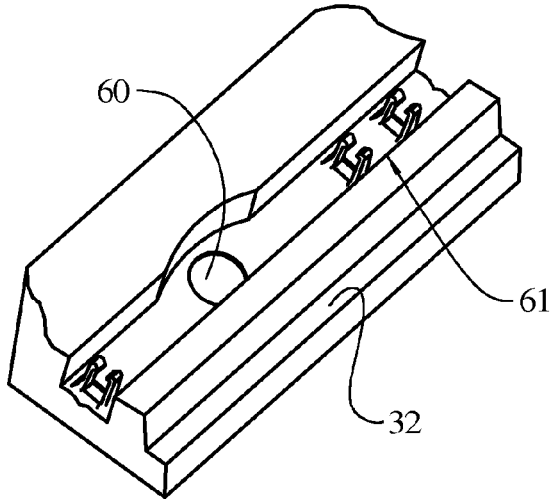
FIG. 3 is a an enlarged partial elevational view of the endcap of FIG. 2.

In some embodiments, the endcap 32 may be formed of a plastic material. This is particularly useful where the door 24 is formed with a face or edge that is non-planar, such as a contoured door that has a front face that is convex. As shown in FIGS. 2 and 3, the endcap 32 may have a water conduit channel 58 formed therein such that the water conduit may be recessed and hidden from view. The wiring that may also extend from the cabinet to the door could also be received in the channel 58. A central hole 60 in the endcap 32 is provided to allow the first water conduit 38 to pass through, and also the hollow conduit 56, if present, and any wires or other conduits. This hole 60 provides communication between the end of the door 24 where the endcap 32 is located and the interior of the door. Of course, the hole 60 need not be located centrally, but could be located anywhere along the length of the endcap 32.

The endcap 32 may also include clips 61 for holding the water conduits 38, 42, as well as any wires or other conduits, in place. If the endcap 32 is made of plastic, the clips 61 may be formed integrally with the endcap. The configuration of the clips 61 should be adjusted to accommodate whatever conduits are being held. The clips 61 should also be spaced apart to allow for the water conduit end connector 44 or other fittings and wire connectors to be received therebetween, if such connectors and fittings are utilized.

In the illustrated embodiment, the second water conduit 42 has a first portion 64 with a length sufficient to permit the second water conduit to exit from one corner 52 of the cabinet 22 and extend into the endcap 32. The second water conduit 42 also includes a second portion 66 selectively connectable to the first portion 64. The second portion 66 has a length sufficient to permit the second water conduit 42 to exit from the opposite corner 52 of the cabinet 22 and extend into the endcap 32.

Figure 4:
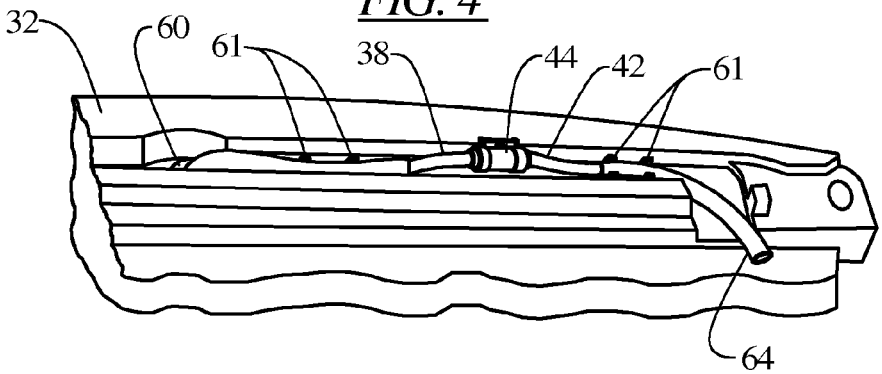
FIG. 4 is a bottom elevational view of the endcap in one partial assembly arrangement.
Figure 5:
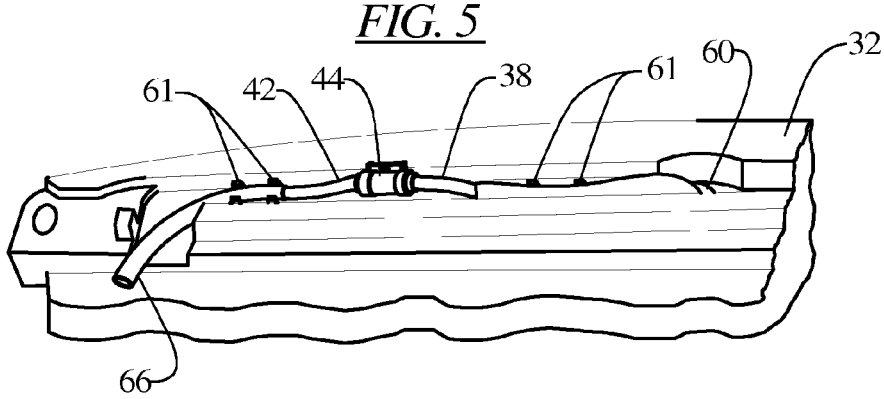
FIG. 5 is a is a bottom elevational view of the endcap in an opposite partial assembly arrangement.
Figure 6:
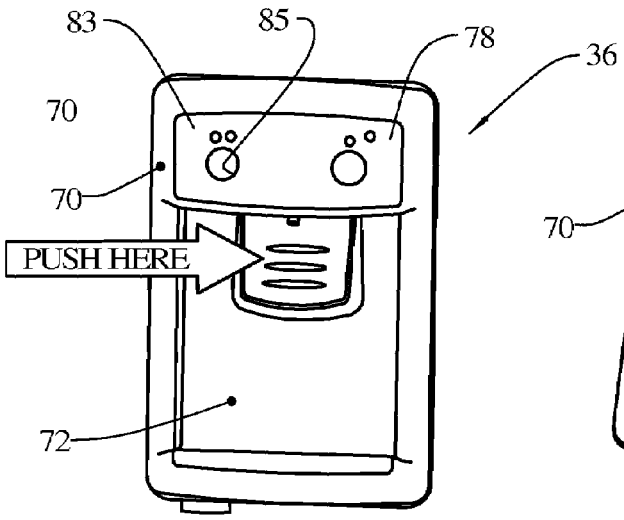
FIG. 6 is a front elevational view of an embodiment of a water dispenser.
Figure 7:
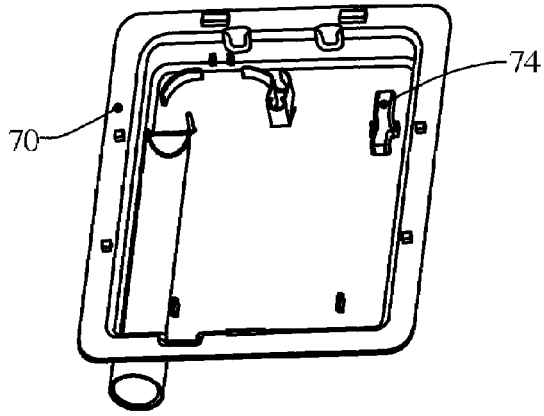
FIG. 7 is a rear elevational view of the dispenser housing.

As an example, as illustrated, the dispenser appliance 20 may be manufactured as a right hand swing model. As such, the wires and water conduit 38 will be routed in the recessed channel 58 within the endcap 32 towards the right hinge side of the appliance as shown in FIG. 4. A wire/tube assembly 42 from the cabinet 22 will exit the appliance through a front rail (hidden behind the endcap 32) and will connect with the water conduit 38 and wires from the door 24 within the endcap channel 58. In order to reverse the door swing, the customer will need to disconnect the water and wires connections 44 in the right side of the channel 58. The first portion of the water/wire assembly 64 from the cabinet 22 will connect to the second portion water/wire assembly 66 that is positioned behind the front rail. This second assembly 66 will only be used for left-hand swing models. The door wire/tube assembly 38 will then be pulled from the clips 61 on the right hand side of the channel 58 and reattached into the clips on the left side of the channel. The connections for wiring and the water tube are then made with the wire/tube assembly 66 that is located across the front of the appliance 20, which exit the appliance at the left hinge side.

This design allows the user to reverse the door swing in a manner that is consistent with the door reversal process for doors without dispensers. There will be no need for the user to disassemble any of the dispenser components in order to reverse or remove the door 24. All of the water and wiring connections can be made at the front of the appliance 20.

Figure 9:
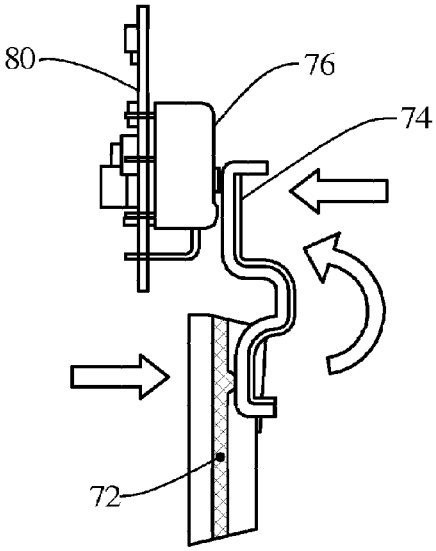
FIG. 9 is a side schematic view of the paddle, toggle and microswitch.
Figure 8:
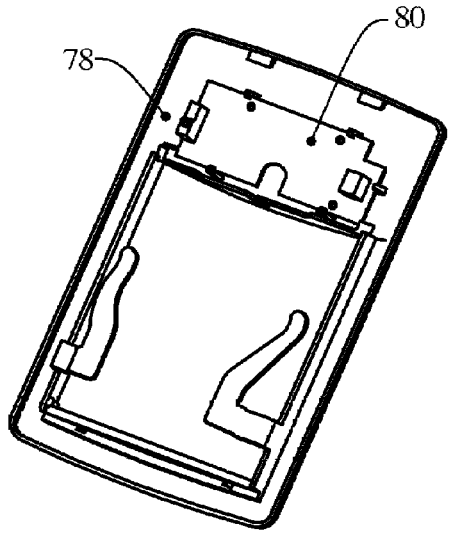
FIG. 8 is a rear elevational view of the bezel.
Figure 10:
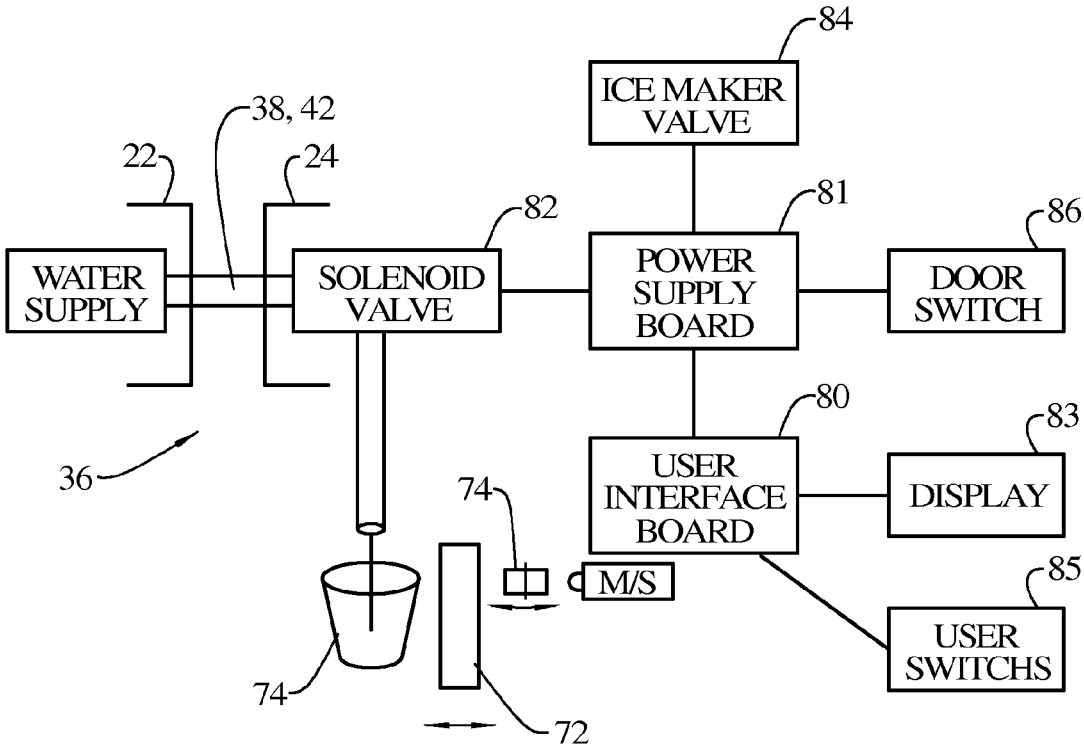
FIG. 10 is a schematic illustration of the components of the water dispenser.

A particular in-door water dispenser 36 which may be used with the endcap 32 arrangement of the present invention is illustrated in FIGS. 6-10. In this embodiment, the in-door water dispenser 36 comprises a dispenser housing 70, a paddle 72 horizontally movable within the dispenser housing, and arranged to be engaged by a user to effect a dispensing of water from the dispenser into a cup 74. A toggle 74 is secured to the dispenser housing 70 and is arranged to be engaged and rotated by horizontal movement of the paddle 72 (FIG. 9). A microswitch 76 is arranged to be operated upon pivotal movement of the toggle 74 by the movement of the paddle 72. A bezel 78 carries a user interface electronic control board 80 which is in communication with the microswitch 76.

A power supply electronic control board 81 is in communication with the user interface electronic control board 80. A water dispenser solenoid valve 82 may be operated by the power supply electronic control board 81.

In the illustrated embodiment, mounted in the exterior door 24, the dispenser housing 70 has the purpose of containing the bezel 78 and paddle 72 in the correct location and locating the toggle 74 at a fixed position. In the 2-board electronic control system, the user interface board 80 interacts with the user. This control board 80 displays user feedback through LEDs 83 and receives user input through switches 85 and communicates with the power supply board 81. This board 81 has the purpose of supplying power to and communicating with the user interface board 80, operating water dispenser valve 82, and monitoring an ice maker valve 84 and door switch 86. The 2-board electronic control system interacts with the toggle 74, bezel 78, and water dispenser solenoid valve 82, as well as interacts with the paddle 72 through the toggle. The toggle 74 is attached directly to the dispenser housing 70 in a fixed position, but can move in an opposing manner to transfer the paddle movement to actuate the microswitch 76, which is mounted on a backside of the user interface board 80. The user interface board 80 is mounted in the bezel 78, which is attached directly to the dispenser housing 70. The paddle 72 is located within the bezel 78, allowing movement horizontally to actuate the toggle 74.

Water is dispensed when the user presses the paddle 72, which moves in a horizontal manner to actuate the toggle 74. This in turn actuates the microswitch 76 by moving in a horizontally opposite manner. The microswitch 76 is mounted on the backside of the user interface board 80, which then communicates to the power supply board 81 to tell it to activate the water dispenser solenoid valve 82. The power supply board 81 then activates the water dispenser solenoid valve 82 for a length determined by the continued communication request received from the user interface board 80. The user interface board 80 will continue the communicated request to the power supply board 81 as long as the paddle 72 is depressed, actuating the microswitch 76. When the user releases the paddle 72, the toggle 74 will rotate back to its original position releasing the microswitch 76. The user interface board 80, in turn will communicate to the power supply board 81 to deactivate the water dispenser solenoid valve 82. The power supply board 81 will then deactivate the water dispenser solenoid 82.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A refrigerator comprising:

an outer cabinet having at least one pivotally openable door to provide access to an interior refrigeration compartment;

an in-door water dispenser positioned in the door and accessible from an exterior of the cabinet;

a water conduit extending from within the cabinet to the water dispenser;

the in-door water dispenser comprising:

a dispenser housing;

a paddle horizontally movable within the dispenser housing, arranged to be engaged by a user to effect a dispensing of water from the dispenser;

a toggle arranged to be engaged and rotated by horizontal movement of the paddle;

a microswitch arranged to be operated upon pivotal movement of the toggle;

a bezel carrying a user interface electronic control board in communication with the microswitch;

a power supply electronic control board in communication with the user interface electronic control board; and a water dispenser solenoid valve operated by the power supply electronic control board.

2. The refrigerator according to claim 1, wherein the user interface electronic control board receives user input through at least one switch.

3. The refrigerator according to claim 1, wherein the user interface electronic control board displays user feedback through at least one LED.

4. The refrigerator according to claim 1, wherein the power supply electronic control board supplies power to the user interface electronic control board.

5. The refrigerator according to claim 1, wherein the power supply electronic control board monitors an icemaker water valve.

6. The refrigerator according to claim 1, wherein the power supply electronic control board monitors a door switch.

7. The refrigerator according to claim 1, wherein the toggle is directly attached to the dispenser housing.

8. The refrigerator according to claim 1, wherein the microswitch is mounted on the backside of the electronic control user interface board.

9. The refrigerator according to claim 1, wherein the power supply electronic control board activates the water dispenser solenoid valve when the toggle engages the microswitch.

10. A refrigerator comprising:

an outer cabinet having at least one pivotally openable door to provide access to an interior refrigeration compartment;

a hinge connection at a pivoting edge of the door to allow the door to pivotally open about the pivoting edge of the door;

an in-door water dispenser positioned in the door and accessible from an exterior of the cabinet;

a water conduit extending from within the cabinet to the water dispenser;

the in-door water dispenser comprising:

a dispenser housing;

a paddle horizontally movable within the dispenser housing, arranged to be engaged by a user to effect a dispensing of water from the dispenser;

a toggle arranged to be engaged and rotated by horizontal movement of the paddle;

a microswitch arranged to be operated upon pivotal movement of the toggle;

a bezel carrying a user interface electronic control board in communication with the microswitch;

a power supply electronic control board in communication with the user interface electronic control board; and a water dispenser solenoid valve operated by the power supply electronic control board.

11. The refrigerator according to claim 10, wherein the hinge connection is selectively movable from the pivoting edge of the door to an opposite edge of the door to permit the door to be alternatively opened from one edge or an opposite edge.

12. The refrigerator according to claim 11, further comprising a removable endcap secured to an edge of the door adjacent to the pivoting edge of the door.

13. The refrigerator according to claim 12, wherein the water conduit further comprises:

a first water conduit extending from the in-door water dispenser to an end within the endcap adjacent to the pivoting edge of the door; and a second water conduit extending from within the cabinet to an end exterior of the cabinet adjacent to the pivoting edge of the door and within the endcap.

14. The refrigerator according to claim 13, further comprising at least one end connector located within the endcap arranged to receive the ends of the first and second water conduits.

15. The refrigerator according to claim 14, wherein the second water conduit is selectively arranged to exit from either adjacent one corner or adjacent an opposite corner of the cabinet to be adjacent to the pivoting edge of the door.

16. The refrigerator according to claim 15, wherein the hinge connection is movable between a bottom right and left corner of the door, the endcap is positioned along a bottom edge of the door, and the second conduit is selectively arranged to exit from either adjacent a bottom right corner or adjacent a bottom left corner of the cabinet.

17. The refrigerator according to claim 15, wherein the second water conduit has a first portion with a length sufficient to permit the second water conduit to exit from one corner of the cabinet and extend into the endcap and includes a second portion selectively connectable to the first portion, the second portion having a length sufficient to permit the second water conduit to exit from an opposite corner of the cabinet and extend into the endcap.

* * * * *